US008534091B2

(12) United States Patent
Lee et al.

(10) Patent No.: US 8,534,091 B2
(45) Date of Patent: Sep. 17, 2013

(54) REFRIGERATOR RELATED TECHNOLOGY

(75) Inventors: Youn Seok Lee, Seoul (KR); Jang Seok Lee, Seoul (KR); Min Kyu Oh, Seoul (KR); Kyeong Yun Kim, Seoul (KR); Su Nam Chae, Seoul (KR)

(73) Assignee: LG Electronics Inc., Seoul (KR)

( * ) Notice: Subject to any disclaimer, the term of this patent is extended or adjusted under 35 U.S.C. 154(b) by 951 days.

(21) Appl. No.: 12/633,941

(22) Filed: Dec. 9, 2009

(65) Prior Publication Data

US 2010/0180625 A1 Jul. 22, 2010

(30) Foreign Application Priority Data

Jan. 21, 2009 (KR) ..... 10-2009-0005007

(51) Int. Cl.
*F25D 17/06* (2006.01)

(52) U.S. Cl.
USPC ..... 62/419; 62/449

(58) Field of Classification Search
USPC ..... 62/419, 414, 314, 407, 449, 515
See application file for complete search history.

(56) References Cited

U.S. PATENT DOCUMENTS

| | | | | |
|---|---|---|---|---|
| 3,712,078 | A | 1/1973 | Maynard et al. | |
| 4,913,223 | A * | 4/1990 | Mizuno et al. | 165/61 |
| 6,735,976 | B2 | 5/2004 | Lee | |
| 6,997,008 | B2 | 2/2006 | Lee et al. | |
| 7,003,973 | B2 | 2/2006 | Lee et al. | |
| 7,040,118 | B2 | 5/2006 | Jung | |
| 7,114,345 | B2 * | 10/2006 | Kim et al. | 62/296 |
| 7,185,509 | B2 * | 3/2007 | Lee et al. | 62/419 |
| 7,188,490 | B2 * | 3/2007 | Jeong et al. | 62/448 |
| 7,322,209 | B2 | 1/2008 | Hwang et al. | |
| 2004/0139763 | A1 | 7/2004 | Jeong et al. | |
| 2005/0218766 | A1 | 10/2005 | Hwang | |

FOREIGN PATENT DOCUMENTS

| | | | |
|---|---|---|---|
| CN | 1517643 | A | 8/2004 |
| EP | 1443289 | A1 | 8/2004 |
| EP | 1443289 | B1 | 1/2011 |
| JP | 03-102169 | A | 4/1991 |
| JP | 7-19704 | | 1/1995 |
| JP | 2000-193359 | A | 7/2000 |
| JP | 2001-248949 | A | 9/2001 |
| JP | 2002-267325 | A | 9/2002 |
| KR | 10-0493691 | A | 5/2005 |

OTHER PUBLICATIONS

PCT International Search Report and Written Opinion dated Apr. 20, 2011 for Application No. PCT/KR2009/06862, 11 pages.
Chinese Office Action dated Oct. 30, 2012 for Application No. 2009-80156783, with English Translation, 16 pages.

* cited by examiner

*Primary Examiner* — Mohammad M Ali
(74) *Attorney, Agent, or Firm* — Fish & Richardson P.C.

(57) ABSTRACT

A refrigerator, in which an evaporator and a cold air fan are horizontally arranged in a cold air generating compartment positioned at an upper portion of the refrigerator. The evaporator and the cold air fan extend along a depth of the refrigerator in forward and rearward directions of the refrigerator.

20 Claims, 6 Drawing Sheets

REFRIGERATOR RELATED TECHNOLOGY

CROSS REFERENCE TO RELATED APPLICATION

This application claims the benefit of Korean Patent Application No. 10-2009-0005007, filed on Jan. 21, 2009, which is hereby incorporated by reference as if fully set forth herein.

FIELD

The present disclosure relates to refrigerator technology.

BACKGROUND

A refrigerator is used to supply cold air generated at an evaporator to a storage compartment (e.g., a refrigerating and/or freezing compartment) to maintain freshness of various food products stored in the storage compartment. Such a refrigerator includes a body, in which a storage compartment is defined to store food at a low-temperature state. A door is mounted to a front side of the body to open or close the storage compartment.

A cooling cycle is included in the refrigerator to cool the storage compartment through circulation of a refrigerant. A machine compartment is also defined in the body to accommodate a plurality of electric elements used to configure the cooling cycle.

For instance, the cooling cycle includes a compressor to perform a temperature/pressure increasing operation upon a low-temperature/low-pressure gaseous refrigerant such that the low-temperature/low-pressure gaseous refrigerant is changed into a high-temperature/high-pressure gaseous refrigerant. The cooling cycle also includes a condenser to condense the refrigerant supplied from the compressor, using ambient air, an expansion valve to perform a pressure reducing operation upon the refrigerant supplied from the condenser such that the refrigerant is expanded, and an evaporator to evaporate the refrigerant emerging from the expansion valve in a low pressure state, thereby absorbing heat from the interior of the refrigerator.

SUMMARY

In one aspect, a refrigerator includes a body, a storage compartment defined in a first portion of the body, a door configured to open and close at least a portion of the storage compartment, and a cold air generating compartment defined in an upper portion of the body and configured to supply cold air to the storage compartment. The upper portion of the body is positioned above the storage compartment when the refrigerator is oriented in an ordinary operating orientation. The refrigerator also includes an evaporator positioned in the cold air generating compartment and a cold air fan positioned in the cold air generating compartment and configured to promote movement of air within the cold air generating compartment in a flow direction that passes over the evaporator and is perpendicular to a surface of the door when the door is oriented in a closed position. The refrigerator further includes a guide duct arranged in the body to connect the storage compartment and the cold air generating compartment and configured to guide air flow between the storage compartment and the cold air generating compartment.

Implementations may include one or more of the following features. For example, the cold air generating compartment may extend across a depth of the body from a front side of the body to a rear side of the body and the guide duct may be configured to guide air flowing from a rear side of the storage compartment to the cold air generating compartment and air flowing from the cold air generating compartment to the rear side of the storage compartment. The guide duct may be configured to guide air flowing from the rear side of the storage compartment to a rear side of the cold air generating compartment and air flowing from a front side of the cold air generating compartment to the rear side of the storage compartment.

The guide duct may define a first flow path that guides the air flowing from the rear side of the storage compartment to the rear side of the cold air generating compartment and a second flow path that guides the air flowing from the front side of the cold air generating compartment to the rear side of the storage compartment. The first and second flow paths may be separated from each other.

Further, the refrigerator may include a first duct configured to guide the air flowing from the rear side of the storage compartment to the rear side of the cold air generating compartment and a second duct configured to guide the air flowing from the front side of the cold air generating compartment to the rear side of the storage compartment. The first duct may be arranged at the rear side of the storage compartment and the second duct may be arranged to extend along a top wall of the storage compartment and the rear side of the storage compartment.

The second duct may include an inlet portion arranged at a front side of the top wall of the storage compartment and configured to receive air from the cold air generating compartment and a guide portion arranged at one side of the top wall of the storage compartment, connected to the inlet portion, and configured to guide, within the top wall, cold air received by the inlet portion to the rear side of the storage compartment without entering the storage compartment at the top wall. The second duct also may include a discharge portion arranged at the rear side of the storage compartment, connected to the guide portion, and configured to guide cold air from the guide portion into the storage compartment at the rear side of the storage compartment. The portions of the second duct arranged at the top wall of the storage compartment may be arranged at a bottom wall of the cold air generating compartment. The portion of the second duct arranged at the rear side of the storage compartment may be parallel to and separated from the first duct.

In addition, the refrigerator may include a cold air inlet defined at the first duct and configured to receive cold air from the storage compartment and a cold air outlet defined at the second duct and configured to discharge cold air into the storage compartment. The evaporator may have a vertical length perpendicular to the flow direction of cold air along the evaporator and a horizontal length parallel to the flow direction of cold air such that the vertical length is longer than the horizontal length.

The cold air fan may be arranged in the front or rear of the evaporator in the cold air generating compartment and may be configured to guide cold air received from the first duct such that the cold air flows to the second duct after passing through the evaporator. The cold air fan may include one of a centrifugal fan, an axial fan, and a cross-flow fan. The cold air fan may be configured to propel the cold air toward an inlet of the second duct.

In another aspect, a refrigerator includes a body, a storage compartment defined in a first portion of the body, and a cold air generating compartment defined in an upper portion of the body. The upper portion of the body is positioned above the storage compartment when the refrigerator is oriented in an ordinary operating orientation. The refrigerator also includes an evaporator positioned in the cold air generating compartment and a cold air fan positioned in the cold air generating compartment and configured to promote movement of air within the cold air generating compartment from a rear side of the cold air generating compartment to a front side of the cold air generating compartment. The refrigerator further includes a first duct arranged at a rear side of the storage compartment and configured to guide air from the rear side of the storage compartment to the rear side of the cold air generating compartment and a second duct that is arranged to extend along the rear side of the storage compartment and a top wall of the storage compartment, that is separated from the first duct, and that is configured to guide air from the front side of the cold air generating compartment to the rear side of the storage compartment.

Implementations may include one or more of the following features. For example, the first duct may communicate with a rear side of a bottom wall of the cold air generating compartment and the second duct may communicate with a front side of the bottom wall of the cold air generating compartment. The refrigerator may include an inlet defined at the first duct and configured to guide air from the storage compartment to the first duct and an outlet defined at the second duct and configured to guide air from the second duct to the storage compartment.

In addition, the second duct may include an inlet portion arranged at a front side of the top wall of the storage compartment and configured to receive air from the cold air generating compartment. The second guide duct also may include a guide portion arranged at one side of the top wall of the storage compartment, connected to the inlet portion, and configured to guide cold air from the inlet portion to the rear side of the storage compartment without entering the storage compartment at the top wall. The second guide duct further may include a discharge portion arranged at the rear side of the storage compartment, connected to the guide portion, and configured to guide cold air from the guide portion into the storage compartment at the rear side of the storage compartment.

In some examples, the refrigerator may include a door configured to open and close at least a portion of the storage compartment. In these examples, the cold air fan may be configured to promote movement of air within the cold air generating compartment in a flow direction that passes over the evaporator and is perpendicular to a surface of the door when the door is oriented in a closed position. The evaporator may have a vertical length perpendicular to the flow direction of cold air along the evaporator and a horizontal length parallel to the flow direction of cold air such that the vertical length is longer than the horizontal length.

DETAILED DESCRIPTION

Figure 1:
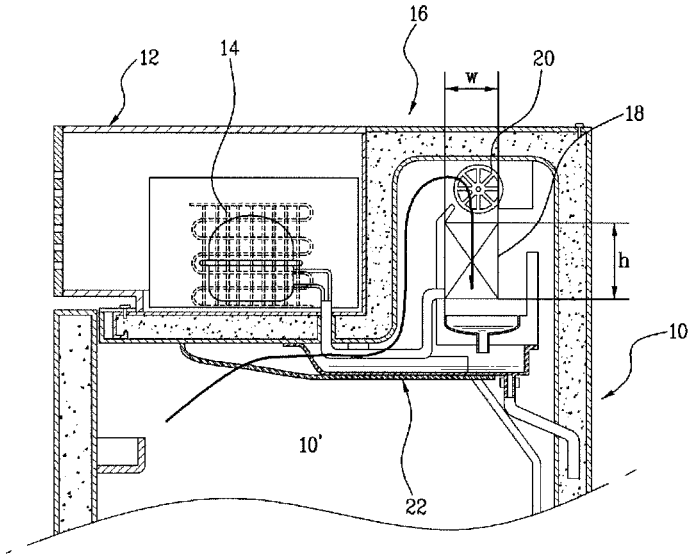
FIG. 1 is a partial sectional view illustrating a part of a configuration of an example refrigerator.

FIG. 1 illustrates an example refrigerator. As shown in FIG. 1, the refrigerator includes a body 10. A storage compartment 10' is defined in the body 10 to store food therein. A machine compartment 12 is defined in an upper portion of the body 10. The machine compartment 12 accommodates a plurality of electric elements used in a cooling cycle including a compressor 14 to compress a refrigerant, etc.

A cold air generating compartment 16 also is defined in the upper portion of the body 10 at one side of the machine compartment 12. An evaporator 18 that generates cold air through heat exchange is arranged in the cold air generating compartment 16. In some examples, the evaporator 18 is configured such that a vertical length thereof (h) is longer than a lateral length thereof (w).

A cold air fan 20 is arranged over the evaporator 18. The cold air fan 20 draws cold air from the storage compartment 10' in order to allow the cold air to heat-exchange with the evaporator 18. A guide duct 22 defines a flow path of cold air and is arranged beneath the evaporator 18.

In the refrigerator shown in FIG. 1, the cold air generating compartment 16 extends in a vertical direction for a relatively long length because the evaporator 18 and cold air fan 20 are vertically arranged. As a result, the guide duct 22, etc. arranged beneath the cold air generating compartment 16 protrude into the storage compartment 10'. Where the guide duct 22, etc. protrude into the storage compartment 10', as mentioned above, the capacity of a storage compartment of the refrigerator is reduced.

In addition, the evaporator 18 has an enhanced heat exchange efficiency when it has an increased cold air introduction area at a front side thereof. In the refrigerator shown in FIG. 1, increasing the cold air introduction area at the front side of the evaporator 18 facing the cold air fan 20 has limitations because a space allowing cold air to flow along the evaporator 18 is provided and the cold air fan 20 is arranged over the evaporator 18. That is, the evaporator 18 has a length (w) perpendicular to a flow direction of cold air along the evaporator 18 and a length (h) parallel to the flow direction of cold air such that the length (w) is shorter than the length (h). As a result, a reduction in heat exchange efficiency due to flow resistance may exist.

Figure 2:
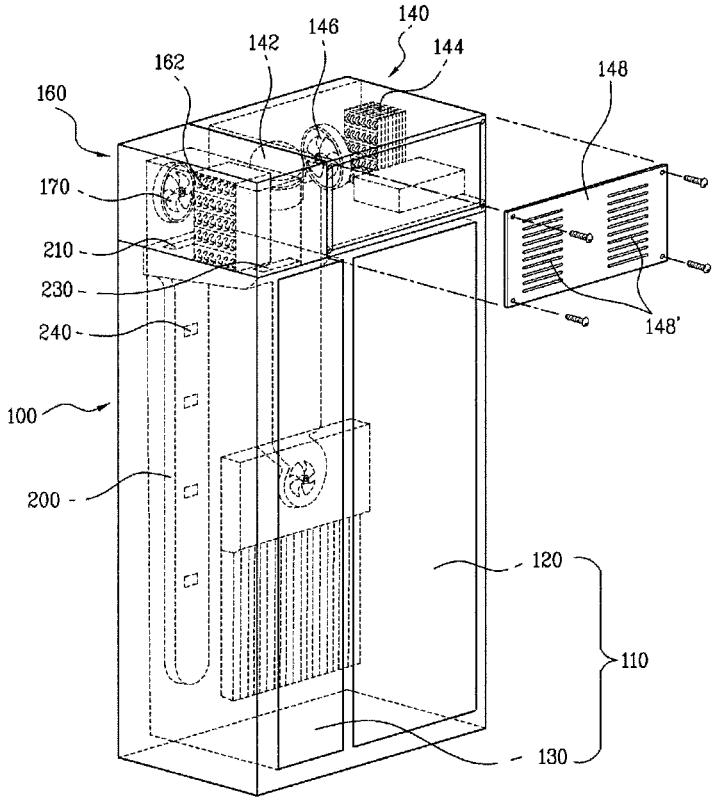
FIG. 2 is a perspective view illustrating a configuration of an example refrigerator.
Figure 3:
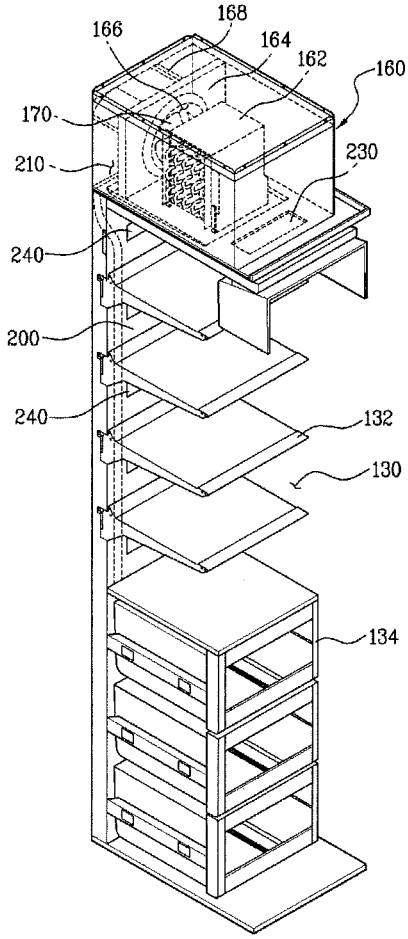
FIGS. 3 and 4 are a side view and a sectional view illustrating a configuration of an example refrigerator.
Figure 4:
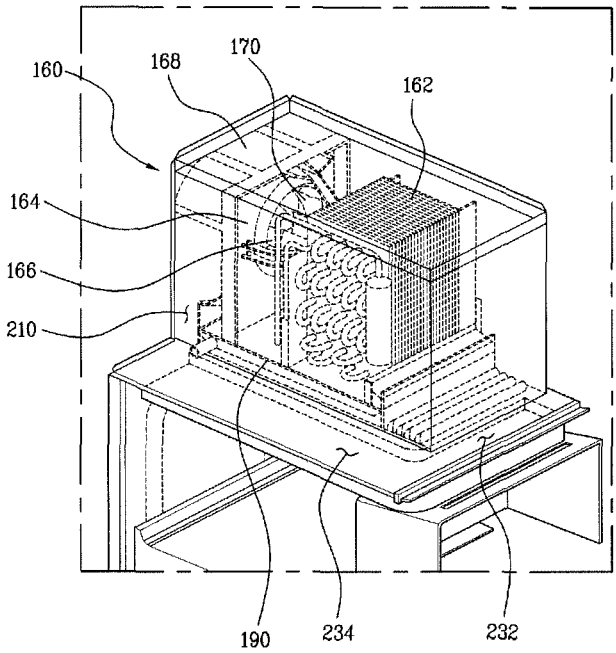
Figure 5:
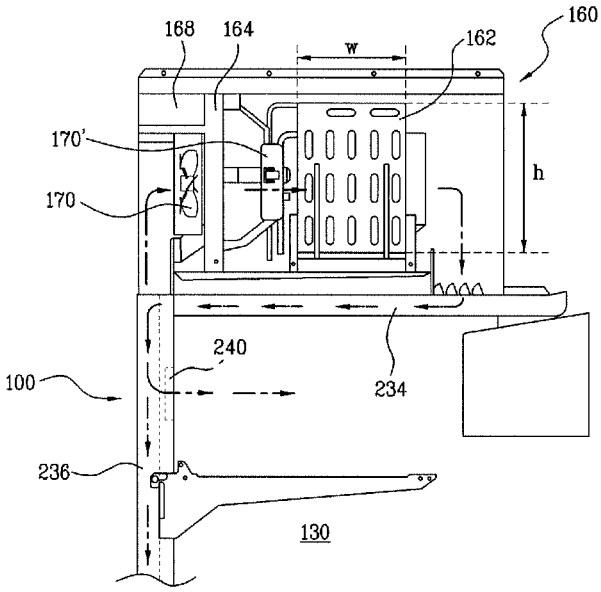
FIG. 5 is a sectional view illustrating a configuration of an example refrigerator.
Figure 6:
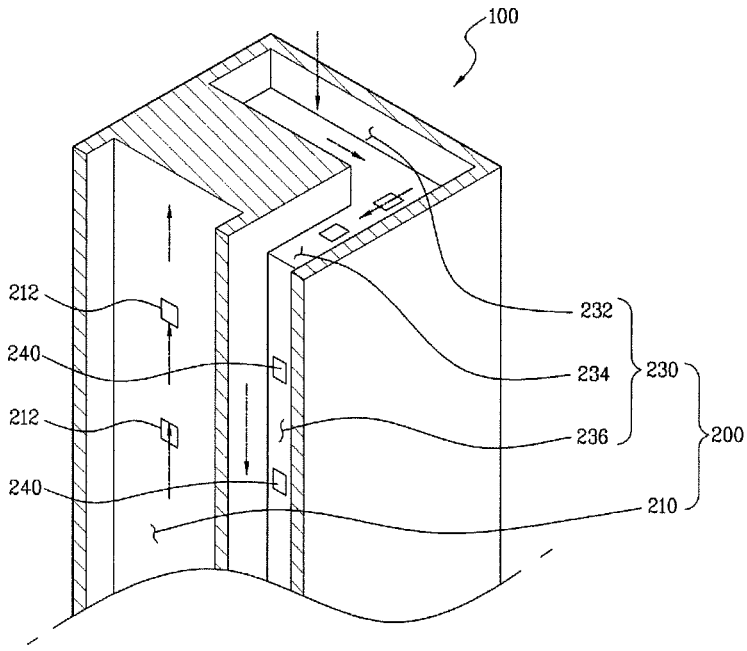
FIG. 6 is a sectioned perspective view schematically illustrating an example structure of a guide duct.

FIG. 2 illustrates a configuration of an example refrigerator. FIGS. 3 and 4 illustrate an example configuration of the refrigerator shown in FIG. 2. FIG. 5 illustrates an example configuration of the refrigerator shown in FIG. 2. FIG. 6 illustrates an example structure of a guide duct.

As shown in the drawings, in a body 100 that defines an appearance and a frame of the refrigerator, a storage compartment 110 is defined. The storage compartment 110 is a space to store food therein. The storage compartment 110 is divided into a refrigerating compartment 120 and a freezing compartment 130. A plurality of racks 132 are vertically arranged in the storage compartment 110. A drawer type storage compartment 134 also is defined beneath the racks.

A machine compartment 140 is defined in an upper portion of the body 100. The machine compartment 140 accommodates one or more elements of a refrigeration cycle. Accommodated in the machine compartment 140 are a compressor 142 to perform a temperature/pressure increasing operation upon a low-temperature/low-pressure gaseous refrigerant such that the low-temperature/low-pressure gaseous refrigerant is changed into a high-temperature/high-pressure gaseous refrigerant. A condenser 144 to condense the refrigerant supplied from the compressor 142, using ambient air, an expansion valve to perform a pressure reducing operation upon the refrigerant supplied from the condenser 144 such that the refrigerant is expanded, and a blowing fan 146 to draw in ambient air, thereby cooling the condenser 144, are also accommodated in the machine compartment 140. The machine compartment 140 is screened by a cover member 148 that has at least one through hole 148'.

As shown in FIGS. 3 and 5, a cold air generating compartment 160 is defined in an upper portion of the body 100 at one side of the machine compartment 140. The cold air generating compartment 160 is a space in which a configuration to generate cold air to maintain the storage space at low temperature is installed. The cold air generating compartment 160 is separated from the storage compartment 110 by one or more walls.

The cold air generating compartment 160 extends from a front side of the body 100 to a rear side of the body 100. In the cold air generating compartment 160, an evaporator 162 and a cold air fan 170 are horizontally arranged. The evaporator 162 absorbs heat from the surroundings when a refrigerant emerging from the expansion valve is evaporated in a low temperature state.

The cold air generating compartment extends in a horizontal direction. Cold air is introduced into the cold air generating compartment 160 at a front side of the cold air generating compartment 160, and is discharged out of the cold air generating compartment 160 at a rear side of the cold air generating compartment 160. Accordingly, the evaporator 162 can extend lengthily in a vertical direction of the cold air generating compartment 160. That is, the evaporator 162 has a length h perpendicular to a flow direction of cold air along the evaporator 162 and a length w parallel to the flow direction of cold air such that the length h is longer than the length w.

An orifice 164, which has an orifice hole 166, is arranged around the evaporator 162. A guide member 168 is arranged at one side of a top of the orifice hole 166. The guide member 168 guides cold air emerging from the storage compartment 110 to the cold air fan 170.

The cold air fan 170 is arranged at the rear of the evaporator 162 in the cold air generating compartment 160 to guide cold air emerging from a first duct 210 such that the cold air flows across the evaporator 162 to a second duct 230. The cold air fan 170 may be one of a centrifugal fan, an axial fan, or a cross-flow fan, to move (e.g., expel) cold air toward an inlet of the second duct 230. As shown, the cold air fan 170 is arranged in the rear of the cold air generating compartment 160 and evaporator 162. In other examples, the cold air fan 170 may be arranged in the front of the cold air generating compartment 160 and evaporator 162 in accordance with design conditions.

A cold air fan motor 170' that drives the cold air fan 170 is provided at the orifice 164 (FIG. 5). The cold air fan motor 170' is arranged at an extension from one side of the orifice 164.

Cold air is introduced into the cold air generating compartment 160 at the rear side of the cold air generating compartment 160, and is discharged out of the cold air generating compartment 160 at the front side of the cold air generating compartment 160. The rear side of the cold air generating compartment 160 communicates with the first duct 210. The front side of the cold air generating compartment 160 communicates with the second duct 230. A drain pan 190 is arranged beneath the evaporator 162 to collect defrost water generated during a defrosting operation and then to outwardly discharge the collected defrost water.

In addition, as shown in FIG. 6, a guide duct 200 is provided at the body 100. The guide duct 200 is arranged adjacent to the storage compartment 110. The guide duct 200 communicates with the storage compartment 110 and cold air generating compartment 160 to define a cold air circulation path.

The guide duct 200 includes first and second ducts 210 and 230. The first duct 210 extends in a vertical direction at a rear side of the body 100 to define a flow path that guides cold air to the cold air generating compartment 160.

Cold air inlets 212 are provided at the first duct 210. The cold air inlets 212 guide cold air from the storage compartment 110 to be introduced into the first duct 210.

The second duct 230 is parallel, at a certain portion thereof, to the first duct 210. The second duct 230 defines a flow path that guides cold air emerging from the cold air generating compartment 160 to the storage compartment 110.

The second duct 230 includes an inlet portion 232, into which cold air emerging from the cold air fan 170 is introduced, a guide portion 234 that defines a flow path for guiding the cold air introduced into the inlet portion 232 to flow in a forward/rearward direction of the body 100, and a discharge portion 236 connected to the guide portion 234 extends in parallel to the first duct 210 and discharges the cold air to the storage compartment 110.

The inlet portion 232 corresponds to the inlet of the second duct 230. The inlet portion 232 extends along an edge of the front side of the body 100. The guide portion 234 extends in a forward/rearward direction at one side of the top of the body 100 while being flush with the inlet portion 232.

Since the evaporator 162 and cold air fan 170 are arranged in the cold air generating compartment 160, the guide portion 234 is arranged at one side of the bottom of the cold air generating compartment 160 in order to prevent the guide portion 234 from interfering with the evaporator 162 and cold air fan 170. The discharge portion 236 is separate from the first duct 210. The discharge portion 236 extends in the vertical direction of the body 100, similar to the first duct 210.

Cold air outlets 240 are provided at the second duct 230. The cold air outlets 240 guide cold air cooled to a low temperature while passing along the evaporator 162 such that the cold air is again introduced into the storage compartment 110.

Examples of operation of the refrigerator having the above-described configuration are described with reference to FIGS. 5 and 6.

In the body 100, cold air present in the storage compartment 110 is introduced into the cold air generating compartment 160 after flowing through the cold air inlets 212 and first duct 210. The cold air is cooled in the cold air generating compartment 160 in accordance with heat exchange thereof with the evaporator 162. The cold air is then again introduced into the storage compartment 110 after passing through the second duct 230. For instance, the cold air passes through the inlet portion 232, the guide portion 234, the discharge portion 236, and out of the second duct 230 through the cold air outlets 240.

In accordance with the configurations of the first and second ducts 210 and 220, the flow path of cold air introduced from the storage compartment 130 into the cold air generating compartment 160 and the flow path of cold air introduced into the storage compartment 130 after being discharged out of the cold air generating compartment 160 may be separate from each other.

Further, heat exchange is performed in the cold air generating compartment 160 arranged at the upper portion of the body 100. Because the cold air generating compartment 160 extends in forward and rearward directions of the body 100 and the evaporator 162 and cold air fan 170 are installed in an aligned state in a longitudinal direction of the cold air generating compartment 160, the guide duct 200 does not extend into the storage compartment 110 even though it is arranged between the storage compartment 110 and the cold air generating compartment 160. The evaporator 162, cold air fan 170, and guide duct 200 are installed without regard for the height of the cold air generating compartment 160 because the evaporator 162 and cold air fan 170 are not arranged in a vertical direction, but arranged in forward and rearward directions.

Also, the evaporator 162 is configured such that the length h thereof perpendicular to the flow direction of cold air along the evaporator 162 is longer than the length w thereof parallel to the flow direction of cold air. In the evaporator 162 having the above-described structure, the length of a flow path, through which cold air flows along the evaporator 162, is reduced for a constant heat exchange area, as compared to a structure in which the length of the evaporator perpendicular to the flow direction of cold air is shorter than the horizontal length of the evaporator parallel to the flow direction of cold air. As a result, the flow resistance of cold air is reduced, as compared to the latter structure.

Even if the guide duct 200, which defines the cold air introduction and discharge paths, is not arranged at the front side of the body 100, but arranged at the rear side of the body 100, the door opening and closing operations of the refrigerator does not interfere with the circulation of cold air.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A refrigerator comprising:

a body;

a storage compartment defined in a first portion of the body;

a door configured to open and close at least a portion of the storage compartment;

a cold air generating compartment defined in an upper portion of the body and configured to supply cold air to the storage compartment, the upper portion of the body being positioned above the storage compartment when the refrigerator is oriented in an ordinary operating orientation;

an evaporator positioned in the cold air generating compartment;

a cold air fan positioned in the cold air generating compartment and configured to promote movement of air within the cold air generating compartment in a flow direction that passes over the evaporator and is perpendicular to a surface of the door when the door is oriented in a closed position; and a guide duct arranged in the body to connect the storage compartment and the cold air generating compartment and configured to guide air flow between the storage compartment and the cold air generating compartment, wherein the guide duct is configured to guide air flowing from a rear side of the storage compartment to the cold air generating compartment, and air flowing from the cold air generating compartment to the rear side of the storage compartment, and wherein air flows from a rear side of the body to a front side of the body in the cold air generating compartment and air flows from the front side of the body to the rear side of the body in the guide duct after going through the cold air generating compartment.

2. The refrigerator according to claim 1, wherein:

the cold air generating compartment extends across a depth of the body from the front side of the body to the rear side of the body.

3. The refrigerator according to claim 2, wherein the guide duct is configured to guide air flowing from the rear side of the storage compartment to a rear side of the cold air generating compartment, and air flowing from a front side of the cold air generating compartment to the rear side of the storage compartment.

4. The refrigerator according to claim 3, wherein the guide duct defines a first flow path that guides the air flowing from the rear side of the storage compartment to the rear side of the cold air generating compartment, and a second flow path that guides the air flowing from the front side of the cold air generating compartment to the rear side of the storage compartment, the first and second flow paths being separated from each other.

5. The refrigerator according to claim 3, wherein the guide duct comprises:

a first duct configured to guide the air flowing from the rear side of the storage compartment to the rear side of the cold air generating compartment; and a second duct configured to guide the air flowing from the front side of the cold air generating compartment to the rear side of the storage compartment.

6. The refrigerator according to claim 5, wherein:

the first duct is arranged at the rear side of the storage compartment; and the second duct is arranged to extend along a top wall of the storage compartment and the rear side of the storage compartment.

7. The refrigerator according to claim 6, wherein the second duct comprises:

an inlet portion arranged at a front side of the top wall of the storage compartment and configured to receive air from the cold air generating compartment;

a guide portion arranged at one side of the top wall of the storage compartment, connected to the inlet portion, and configured to guide, within the top wall, cold air received by the inlet portion to the rear side of the storage compartment without entering the storage compartment at the top wall; and a discharge portion arranged at the rear side of the storage compartment, connected to the guide portion, and configured to guide cold air from the guide portion into the storage compartment at the rear side of the storage compartment.

8. The refrigerator according to claim 6, wherein the portions of the second duct arranged at the top wall of the storage compartment are arranged at a bottom wall of the cold air generating compartment.

9. The refrigerator according to claim 6, wherein the portion of the second duct arranged at the rear side of the storage compartment is parallel to and separated from the first duct.

10. The refrigerator according to claim 5, further comprising:

a cold air inlet defined at the first duct and configured to receive cold air from the storage compartment; and a cold air outlet defined at the second duct and configured to discharge cold air into the storage compartment.

11. The refrigerator according to claim 1, wherein the evaporator has a vertical length perpendicular to the flow direction of cold air along the evaporator and a horizontal length parallel to the flow direction of cold air such that the vertical length is longer than the horizontal length.

12. The refrigerator according to claim 5, wherein the cold air fan is arranged in the front or rear of the evaporator in the cold air generating compartment and is configured to guide cold air received from the first duct such that the cold air flows to the second duct after passing through the evaporator.

13. The refrigerator according to claim 5, wherein the cold air fan comprises one of a centrifugal fan, an axial fan, and a cross-flow fan.

14. The refrigerator according to claim 13, wherein the cold air fan is configured to propel the cold air toward an inlet of the second duct.

15. The refrigerator according to claim 1, wherein the cold air fan is arranged in the front or rear of the evaporator in the cold air generating compartment and is configured to guide cold air received in the cold air generating compartment such that the cold air flows to the guide duct after passing through the evaporator.

16. A refrigerator comprising:

a body;

a storage compartment defined in a first portion of the body;

a cold air generating compartment defined in an upper portion of the body, the upper portion of the body being positioned above the storage compartment when the refrigerator is oriented in an ordinary operating orientation;

an evaporator positioned in the cold air generating compartment;

a cold air fan positioned in the cold air generating compartment and configured to promote movement of air within the cold air generating compartment from a rear side of the cold air generating compartment to a front side of the cold air generating compartment;

a first duct arranged at a rear side of the storage compartment and configured to guide air from the rear side of the storage compartment to the rear side of the cold air generating compartment; and a second duct that is arranged to extend along the rear side of the storage compartment and a top wall of the storage compartment, that is separated from the first duct, and that is configured to guide air from the front side of the cold air generating compartment to the rear side of the storage compartment, wherein the second duct comprises:

an inlet portion arranged at a front side of the top wall of the storage compartment and configured to receive air from the cold air generating compartment;

a guide portion arranged at one side of the top wall of the storage compartment, connected to the inlet portion, and configured to guide cold air from the inlet portion to the rear side of the storage compartment without entering the storage compartment at the top wall; and a discharge portion arranged at the rear side of the storage compartment, connected to the guide portion, and configured to guide cold air from the guide portion into the storage compartment at the rear side of the storage compartment.

17. The refrigerator according to claim 16, wherein:

the first duct communicates with a rear side of a bottom wall of the cold air generating compartment; and the second duct communicates with a front side of the bottom wall of the cold air generating compartment.

18. The refrigerator according to claim 16, further comprising:

an inlet defined at the first duct and configured to guide air from the storage compartment to the first duct; and an outlet defined at the second duct and configured to guide air from the second duct to the storage compartment.

19. The refrigerator according to claim 16, further comprising:

a door configured to open and close at least a portion of the storage compartment, wherein the cold air fan is configured to promote movement of air within the cold air generating compartment in a flow direction that passes over the evaporator and is perpendicular to a surface of the door when the door is oriented in a closed position.

20. The refrigerator according to claim 19, wherein the evaporator has a vertical length perpendicular to the flow direction of cold air along the evaporator and a horizontal length parallel to the flow direction of cold air such that the vertical length is longer than the horizontal length.

* * * * *